United States Patent [19]

Cooke, Jr. et al.

[11] 4,448,250

[45] May 15, 1984

[54] METHOD OF FREEING A HOLLOW TUBULAR MEMBER

[75] Inventors: Claude E. Cooke, Jr.; Leon H. Robinson, both of Houston, Tex.

[73] Assignee: Exxon Production Research Co., Houston, Tex.

[21] Appl. No.: 487,550

[22] Filed: Apr. 22, 1983

[51] Int. Cl.[3] ..... E21B 31/00; E21B 47/06

[52] U.S. Cl. ..... 166/255; 166/301

[58] Field of Search ..... 166/255, 301, 250, 277, 166/297, 64, 253; 73/154; 374/136

[56] References Cited

U.S. PATENT DOCUMENTS

| | | | |
|---|---|---|---|
| 2,764,024 | 9/1956 | Rumble | 374/136 |
| 2,956,626 | 10/1960 | Hall | 166/55 |
| 2,998,068 | 8/1961 | True | 166/55 |
| 3,122,016 | 2/1964 | Fordham | 73/154 |
| 3,168,141 | 2/1965 | Lebourg | 174/4.51 |
| 3,268,003 | 8/1966 | Essary | 166/301 |
| 3,363,457 | 1/1968 | Ruehle et al. | 73/154 |
| 3,426,849 | 2/1969 | Brumble, Jr. | 166/255 |
| 3,426,850 | 2/1969 | McDuffie, Jr. | 166/255 |
| 3,480,079 | 11/1969 | Guinn et al. | 166/250 |
| 3,656,344 | 4/1972 | Johns | 73/154 |
| 3,745,822 | 7/1973 | Pierce et al. | 73/154 |
| 3,994,163 | 11/1976 | Rogers | 73/151 |
| 4,074,756 | 2/1978 | Cooke, Jr. | 166/253 |
| 4,105,070 | 8/1978 | Lavigne et al. | 166/250 |
| 4,105,071 | 8/1978 | Nicolas et al. | 166/250 |
| 4,109,717 | 8/1978 | Cooke, Jr. | 166/250 |
| 4,279,304 | 7/1981 | Harper | 166/301 |
| 4,361,193 | 11/1982 | Gravley | 175/61 |
| 4,427,080 | 1/1984 | Steiger | 175/325 |

OTHER PUBLICATIONS

"Radial Differential Temperature (RDT) Logging–A New Tool for Detecting and Treating Flow Behind Casing", by Cooke, Jr., SPE paper 7558, Oct. 1978.

*Primary Examiner*—James A. Leppink
*Assistant Examiner*—Hoang C. Dang
*Attorney, Agent, or Firm*—Marc L. Delflache

[57] ABSTRACT

A hollow tubular member, such as a drill string member (15, 16), stuck by differential pressure against the side wall of a wellbore (10), is released by measuring (21) the temperature distribution around the circumference of the member, determining from this measurement the side which is stuck (17), and then perforating (22) the member at the stuck side to flow fluid into the formation and equalize the pressure behind the stuck portion of the member.

10 Claims, 5 Drawing Figures

FIG. 3
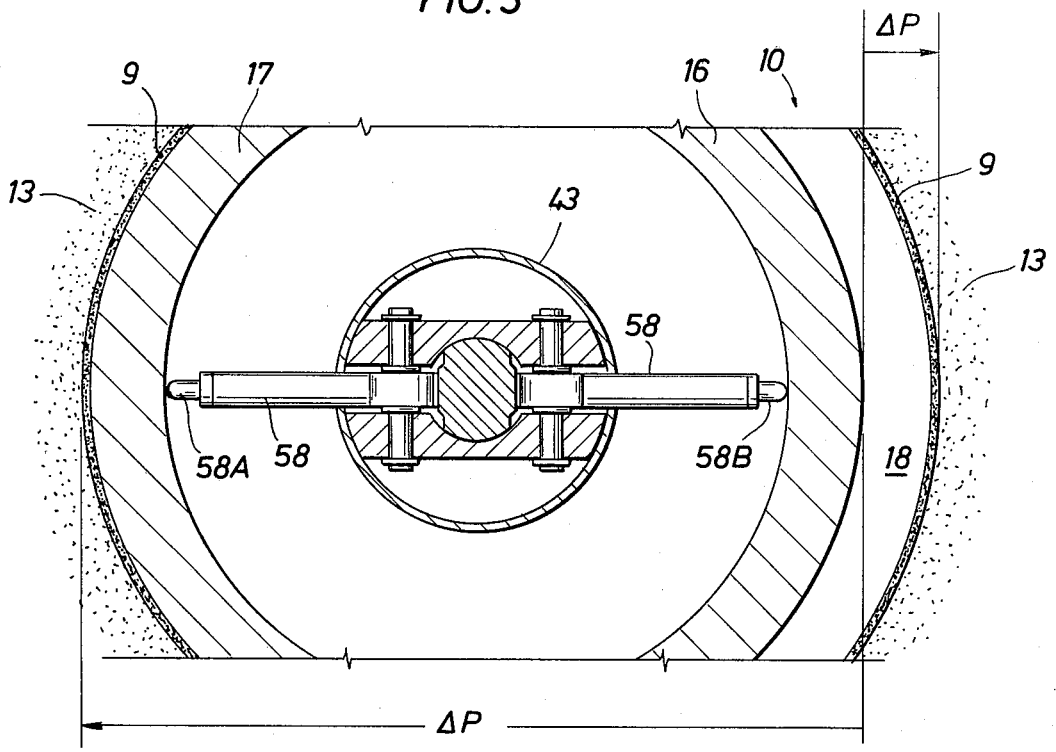
FIG. 4
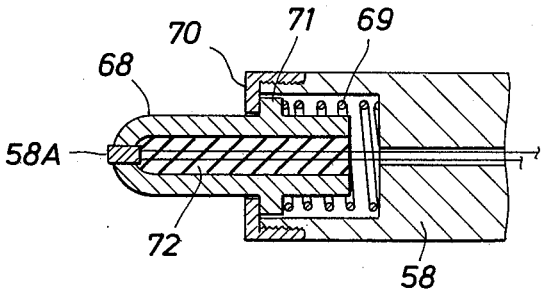
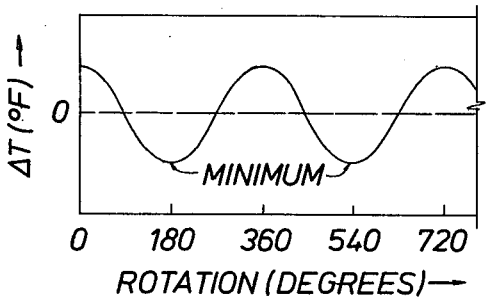
FIG. 5

METHOD OF FREEING A HOLLOW TUBULAR MEMBER

BACKGROUND OF THE INVENTION

1. Field of the Invention

The present invention relates to a method for freeing and releasing hollow tubular members stuck in a borehole. More specifically, the present invention relates to freeing a drill string which has become stuck to the side of a wellbore due to differential pressure between the wellbore and the adjacent formation.

2. Description of the Prior Art

In drilling wells, a common problem is sticking of the drill string in the well. Once stuck, substantial time and money are often lost in trying to free the drill string. Steps taken typically include circulating an oil-base fluid into the annulus around the stuck drill string and using drilling jars in the string. Too often the efforts prove unsuccessful and the drill pipe must be severed above the stuck point to remove the free portion from the well. The stuck portion left behind must then be removed by specialized "fishing" techniques and tools. If this proves uneconomic or impossible, the well must either be abandoned, or it may be sidetracked and re-drilled below the point at which the drill pipe became stuck. None of these prior art techniques is satisfactory.

Especially troublesome, particularly in wells penetrating formations having lower than normal pore pressures, is sticking due to differential pressure between the formation and the wellhole. The pressure in the wellbore will preferably always be greater than the adjacent formation pressure, to prevent formation fluids from entering the wellbore. Greater than normal pressure differentials may be encountered, however, in partially depleted reservoirs where production of offset wells has reduced the original pressure of the zone. Normally, this pressure differential can be maintained by a low-permeability filter cake deposited on the walls of the wellbore. A filter cake is formed by the deposit of clays and polymers found within the drilling fluid, and the term is well known to those skilled in the art.

Generally, the part of the drilling string which becomes stuck is a drill collar. Drill collars are larger in diameter than the drill pipe and, therefore, are more likely to bind or jam in narrower or deviated portions of the wellbore. Their larger diameters also present a greater area for the collar to contact the wall of the wellbore. Where greater than normal differential pressures exist, this causes higher sticking forces directed from the wellbore to the formation. Experience shows that partially depleted reservoirs which have lower formation pressures are more likely to have a stuck drill string, particularly at the drill collars, than a less depleted formation have smaller pressure differentials.

A need thus remains for an economical, rapid, and effective method for freeing and releasing a hollow tubular member, such as a drill string, which has become stuck by differential pressure against the wall of a wellbore.

SUMMARY OF THE INVENTION

Briefly, the present invention meets the above needs and purposes with an improved method for relieving the pressure differential between the stuck tubular member and the adjacent wellbore formation. First, the direction or side of the member which is stuck is determined; then at least one hole is formed on the stuck side to allow fluid to flow from inside the member into the formation. Since the permeability of the formation is finite, the fluid flow which is thus established relieves the pressure differential and essentially frees the member.

In the preferred embodiment, a differential temperature measurement is made around the internal circumference of the tubular member at a vertical depth where the member is stuck. Differential temperature measurements can be performed which are very sensitive as taught, for example, in U.S. Pat. Nos. 3,745,822 (Pierce et al., issued July 17, 1973), 4,074,756 (Cooke, Jr., issued Feb. 21, 1978), and 4,109,717 (Cooke, Jr., issued Aug. 29, 1978). Using the apparatus taught therein, it is possible to determine accurately which side (i.e., azimuth direction) of the tubular member has the greatest temperature difference from that of the fluids in the wellbore. Then, in accordance with the teachings of the present invention, that temperature difference determines or indicates the side of the member which is stuck against the filter cake or formation.

Next, the side of the member which has been determined to be stuck is perforated forming a hole which provides communication with the adjacent formation. Any suitable known perforator may be used. In the preferred embodiment the perforation is accomplished using bromine triflouride, a process recently commercialized and discussed in more detail below. The perforator and temperature sensing means may be rotatable so that the firing direction can be aligned with the stuck side of the tubular member. If rotatable, the perforator is aligned with one of the temperature sensors. When the stuck side of the member is located, rotation of the temperature sensing means and perforator are stopped, leaving the perforator aligned with the stuck side of the tubular member. The perforator is then discharged. High pressure from inside the tubular member can then be applied directly against the filter cake eliminating the differential pressure.

Prior to making the temperature measurement, a fluid having a temperature different from the temperature of the formation where the member is stuck may be circulated down through the member and up the annulus between it and the wellbore. This is helpful when there has been little fluid movement in the well for some time and the temperature of fluids downhole has equalized with the temperature of the formation adjacent to the stuck portion of the member. Pumping such a fluid will generate a temperature differential between the stuck and free side of the member which is greater than would have otherwise been obtained. After perforating it may also be advantageous to pump an oil-base fluid through perforations formed.

If a water-base fluid is in the wellbore, it may also be advantageous prior to perforating to pump an oil-base fluid down the member to the depth to be perforated.

BRIEF DESCRIPTION OF THE DRAWINGS

FIG. 3 is a cross-sectional view taken along Section 3—3 of FIG. 1.

FIG. 4 is a cross-sectional view illustrating details of the probe assembly shown in FIGS. 1–3.

FIG. 5 represents a temperature log of the differential temperature measured through 720° of rotation (two revolutions) of the temperature sensing assembly shown in FIGS. 1–4.

DETAIL DESCRIPTION OF THE INVENTION

Figures 1, 2:
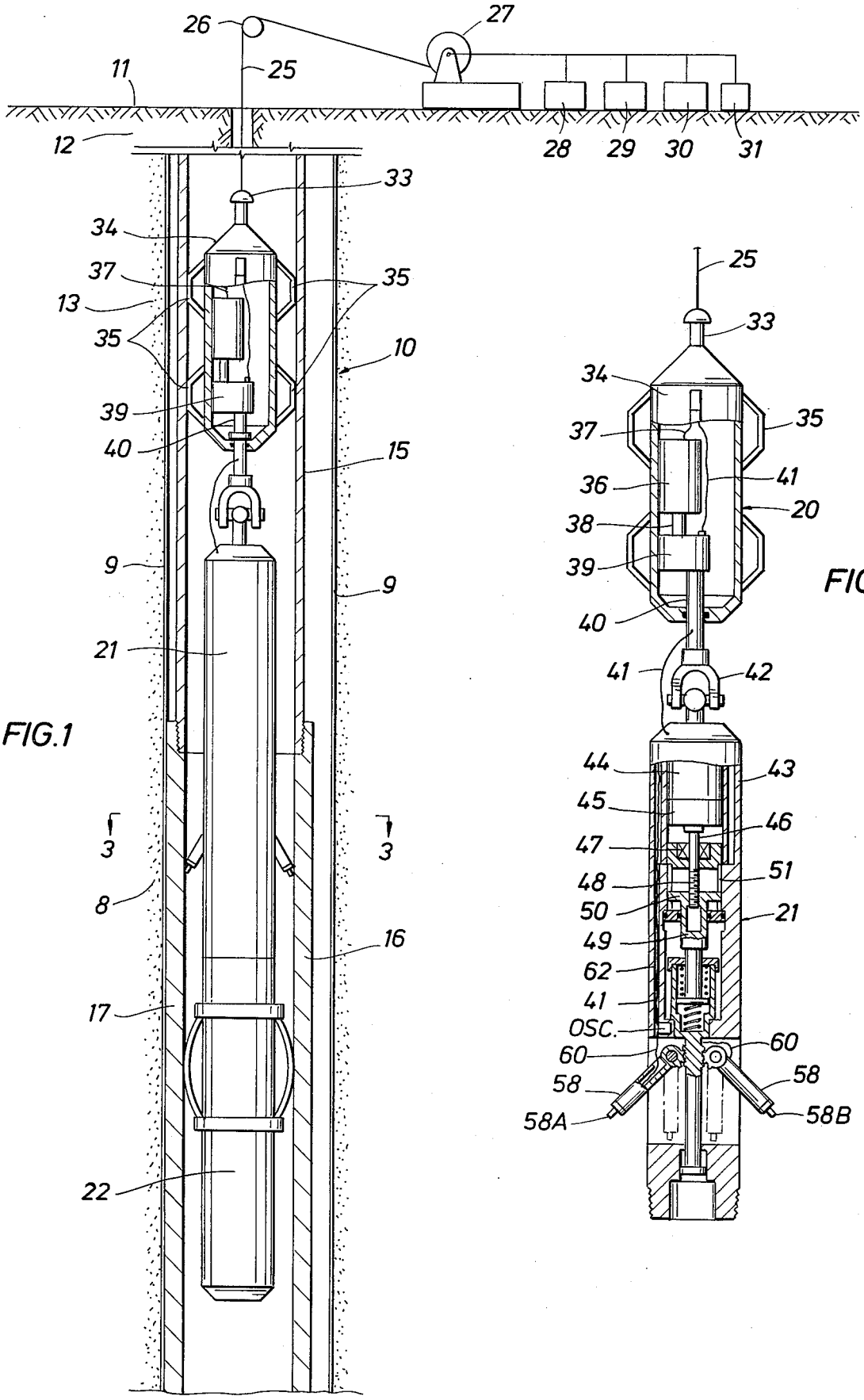
FIG. 1 is a partial cross-sectional view illustrating a drill collar stuck in a well.
FIG. 2 is a longitudinal, partially cross-sectional view showing details of the rotational and temperature sensing assemblies shown in FIG. 1.

Referring to FIG. 1, a well 10 extends from ground surface 11 to subsurface formations 12 and 13. The lower portion of FIG. 1 is out-of-scale to more clearly illustrate the details of an apparatus which can be used to practice the present invention. A hollow tubular drill string 15 (also referred to herein as "tubular member" or "member") includes a drill collar 16 secured to its lower end. Side 17 of drill collar 16 is stuck against filter cake 9 on the wall 8 of the wellbore. This is due to differential pressure (represented by the vector Δ P in FIG. 3). The vector Δ P is in the direction from the high pressure in the wellbore toward the lower pressure in the formation.

An apparatus that can be used to practice the present invention is described in the above-noted U.S. Pat. No. 4,074,756, the disclosure of which is incorporated herein by reference. Briefly, the apparatus includes a rotator assembly 20 and a temperature sensing assembly 21. Operatively associated and adapted to be lowered therewith through the drill string 15 is a perforating gun 22. Gun 22 is preferably connected to the temperature sensing assembly 21 and rotator assembly 20, at a predetermined angular relationship with respect thereto, so that it rotates along with them.

The three components (22, 21 and 20), assembled as illustrated, are lowered into the well 10 on a cable 25. The cable 25 moves over a pulley 26 at the wellhead, and a cable drum 27 raises and lowers the apparatus as desired. Suitable electrical signals from the downhole apparatus are transmitted to a rotator assembly control 28, a temperature sensor motor control 29, and a temperature sensor output analyzer 30. A perforating gun discharge control 31 is also connected by means of the cable 25 to the perforating gun 22.

Referring to FIG. 2, the rotator assembly 20 is provided with a fishing neck 33 through which the cable 25 passes. A rotator housing 34, shown cutaway, has centralizers 35 suitably attached to its external surface to minimize rotation of the exterior of the assembly 20. Mounted within the housing 34 is a reversible electric motor 36 which is powered by the rotator assembly control 28 through cable 25 and leads 37. The output shaft 38 of motor 36 is connected to a suitable power transmission assembly 39, such as a gear box, and serves to rotate the temperature sensing assembly 21 and perforating gun 22.

A cable 41 passes through a power transmission output shaft 40 and electrically interconnects with cable 25 and the temperature sensing assembly 21. The power transmission output shaft 40 is connected to the temperature sensing assembly 21 by a suitable flexible joint 42. Thus, when the motor 36 is actuated by the operator at the rotator assembly control 28, the temperature sensing assembly 21 will rotate about its vertical axis due to the frictional contact of the centralizers 35 on the wall of drill string 15.

As shown in FIGS. 1–3, the temperature sensing assembly 21 includes two temperature probes 58 for making differential temperature measurements. Assembly 21 also includes electrically powered transmission means for moving the probes from a retracted, running-in position to an extended, operating position.

The temperature sensing assembly 21 is provided with an external housing 43 which couples at its lower end with the perforating gun 22. At the upper end of the external housing 43 there is an opening through which the cable 41 passes. Suitable leads from the cable 41 are provided for powering an electrically reversible temperature sensor motor 44 which supplies rotary power to a suitable power transmission 45. The power transmission output shaft 46 is journaled by bearings 47 and has a threaded lower end 48. A connecting member 49 has a threaded central bore which mates with the threaded lower end 48 of the power output shaft 46. Keys 50 are provided at the upper end of a connecting member 49 and ride in key slots 51. Thus, rotation of the output shaft 46 causes vertical movement of the connecting member 49, since rotational motion of member 49 is prevented by keys 50 and slots 51.

The temperature sensing assembly shown in FIGS. 1–3 has two probe 58 disposed 180° apart about the vertical axis of the temperature sensing assembly 21. While this disclosure emphasizes the use of two probes, it should be understood that any number of probes may be used in a sensor assembly to practice the present invention. Indeed, even a single probe may be used, and the temperature sensing assembly would then include an internal temperature sensor (not shown) to read internal drill string temperatures (see U.S. Pat. No. 4,109,717, the disclosure of which is incorporated herein by reference).

As shown in FIG. 2, each probe 58 contains a temperature sensor, one of which is shown as 58A. The sensor is electrically connected to an oscillator (designated "OSC" in FIG. 2). The temperature sensors may be of the resistance type, such as thermistors; the oscillator may be of the resistance controlled pulse type (e.g., unijunction relaxation). Variations in the frequency of the oscillator are directly proportional to differences in resistance between the temperature sensors, and hence are proportional to temperature differences between opposite points on the drill collar 16.

FIG. 3 shows the relative positions of the two probes 58A and 58B in the temperature sensor. Probe 58A is shown touching the stuck side 17 of drill collar 16, while probe 58B is touching the free side of drill collar 16 which is in contact with wellbore fluids 18.

As best seen in FIG. 4, the probe 58 terminates in probe tip 68. A biasing spring 69 forces tip 68 outward relative to the probe 58 and assures proper contact of the probe tip 68 with the internal wall of the drill string 15. Probe tip 68 is secured within the probe by a cap 70 and a flange 71. The temperature sensor 58A is positioned in a central bore in the probe tip 68 and secured in the tip by an electrically insulating potting material 72.

Referring to FIG. 2 again, from each probe a conductor 60 is electrically connected with the oscillator. The output from the oscillator is connected via cable 41 (which passes through one of the slots 62 in the temperature sensor housing), cable 25, and brushes in pulley 26 to output analyzer 30. In the output analyzer 30, the oscillator output is connected to the input of a counting rate meter. The counting rate meter is connected with a differential amplifier. The differential amplifier generates an output signal directly proportional to the output signal from the counting rate meter, which is proportional to the frequency of the oscillator and therefore proportional to the temperature difference between the temperature sensors. The output of the differential amplifier is connected to a recorder, which provides a continuous recorded display of the temperature differences relative to rotation of the probes, as illustrated in FIG. 5. The specific radial direction of the probes relative to a fixed point, for example the compass direction, is not necessary for the practice of the present invention and is therefore not recorded.

Referring to FIG. 1 again, the perforating gun 22 is preferably fixedly attached to the temperature sensing assembly 21 at a predetermined angle with respect and aligned with one of the temperature probes 58, such as probe 58A. When probe 58A detects the point of maximum positive temperature difference (or negative temperature difference, depending on the setup of the equipment), the gun 22 is aligned in the proper direction for perforating the side of the tubular member which is stuck to the wellbore 10.

The gun 22 may be any number of commercially available designs. It may include a long, thin, rectangular steel strip indicated as numeral 80 in FIG. 1 of U.S. Pat. No. 4,074,756. Discharging selected charge(s) (numeral 81 in FIG. 1 of U.S. Pat. No. 4,074,756) once the maximum temperature differential is obtained will enable the penetration of the drill collar in the desired direction. Depending on the speed of rotation of the assembly 20, an angle between the direction of the probes when maximum temperature differential is read and the actual direction of maximum temperature differential is determined for each type of temperature assembly 26. These measurements are readily made in the laboratory by techniques well known to those skilled in the art.

The gun may include a decentralizer which holds the gun against the wall of the tubular member or at a specified distance from the wall by the action of a spring, or the like (see *COMPOSITE CATALOG OF OIL FIELD EQUIPMENT AND SERVICES,* 1980–81 ed. (34th), published by WORLD OIL, p. 3017 for more detail about decentralizers). These types of guns often use shaped-charged explosives.

Another type of gun that may be used is a bromine triflouride perforator. This type of perforator is chemical. That is, a chemical reaction is triggered which results in the dissolution of selected portions of the drill collar in a controlled manner, thereby forming the perforation. For a more detailed discussion of this type of perforator, see "Chemical Drill Collar Perforator" by J. Terrell et al., *Transactions of the* 1981 *Drilling Technology Conference,* Calgary, Alberta, Canada, Mar. 9–12, 1981, pp 131–150. The use of a decentralizer as mentioned above is necessary when using a bromine triflouride perforator.

OPERATION

If not known, a determination is first made, by conventional means, of the vertical height at which the drill string 15 (which includes drill collar 16) is stuck. Conventional techniques to make such a determination include a free-point indicator log (see *COMPOSITE CATALOG OF OIL FIELD EQUIPMENT SERVICES,* 1980–81 ed. (34th), published by WORLD OIL, p. 2126and U.S. Pat. Nos. 3,994,163 and 4,105,070 for more detail about this type of technique).

The apparatus, which includes assemblies 20, 21 and 22, is then lowered into and through the drill string 15 to the vertical depth at which the string is stuck. If the fluid has been static in the wellbore for some time, or if it is otherwise desirable to enhance the sensitivity of the measurement, a fluid having a temperature different (either higher or lower) from the formation temperature where the drill string is stuck may first be circulated through the drilling string and then back up the annulus between the outside of the string and the wellbore wall. Depending upon the amount of time the fluid has been circulating, the temperature of the fluid, and the depth at which the drill collar is stuck, the circulated fluid will be either hotter or colder than the temperature of the formation at the predetermined depth. However, as the temperature of the side of collar 16 opposite the stuck side 17 moves to equilibrium with the fluid in the borehole, the stuck side 17 will remain at about the temperature of the formation. A measurement of the temperature of the fluid inside the drill string may be made, if desired, to determine whether the free side of the drill string 15, opposite stuck side 17, will become hotter or colder than the stuck side during circulation of the fluid. This measurement is normally made by a conventional temperature log probe which may be attached to the apparatus described herein and placed into operation by voltage variations on the cable 25 using techniques well known to those skilled in the art (see *COMPOSITE CATALOG OF OIL FIELD EQUIPMENT AND SERVICES,* 1980–81 ed. (34th), published by WORLD OIL, p. 3006 for more detail about temperature log probes).

While the apparatus is being lowered through the drill string, the probe assemblies 58 are retracted. Upon reaching the predetermined depth (or vertical height), the temperature sensor motor control 29 is actuated to cause the probes 58 to be extended to contract the interior wall of the drill collar 16. When the probe tips 68 contact a point on the interior wall having a given temperature, a change in the frequency of the oscillator (OSC) will be induced due to the change in the resistances of the temperature sensors. The output will be transmitted to the output analyzer 30, and, as previously discussed, a suitable signal is produced from which a recording such as illustrated in FIG. 5 may be made. Next, the probes 58 are rotated in the drill string. This results in a continuous log of the differential temperature measurements made between successive pairs of corresponding circumferentially displaced points around the interior circumference of the tubular member. The log in FIG. 5 is a representative plot. Assume, for example, that the temperature on the stuck side is greater than the fluid temperature outside of the collar on the free side. Assume further that the positive (greater or higher) indications on the log correspond to temperature measurements in which probe 58A is at a higher temperature than probe 58B. It follows that gun 22 will be precisely aligned with the stuck side of collar 17 when the temperature sensing assembly 21 is rotated to the position generating the peak indications on the log. At this point rotation is stopped and the gun is fired.

After the gun has opened a perforation through the stuck side of the drill collar into the formation, pressure equalization can be accelerated by pumping an oil-base fluid down the string and through the perforation into the filter cake or formation. This facilitates invasion of the filter cake and the formation with the higher pressure fluid contained within the tubular member, and more rapidly relieves the differential pressure between the member and the formation. As mentioned above, it may also be advantageous to circulate an oil-base fluid prior to perforation. This may aid significantly in loosening the drill string from the filter cake at the point of sticking.

While the method herein described constitutes a preferred embodiment of this invention, it is to be understood that the invention is not limited to these precise statements and that changes may be made therein without departure from the spirit and scope of the present invention.

What is claimed is:

1. A method for freeing and releasing a hollow tubular member which has become stuck by differential pressure against the wall of a wellbore, said method comprising the steps of:

measuring temperature distribution around the circumference of said member at a predetermined vertical depth where said member is stuck to determine which side of said member is stuck against the side of the wellbore; and perforating the side of said member determined to be stuck to place the interior of said member in fluid communication with the adjacent formation and to free said member from the side of the wellbore by relieving the differential pressure between the member and the formation.

2. The method of claim 1 wherein:

said temperature measuring step further comprises:

measuring a differential temperature with a differential temperature sensing means capable of making a differential temperature measurement around the interior circumference of said member; and rotating said temperature sensing means around the circumference of said member to measure the temperature distribution around the circumference thereof.

3. The method of claim 2 wherein said perforating step further comprises perforating the side of said member with a perforating means connected to and rotatable with said temperature sensing means at a predetermined angular relationship with respect thereto.

4. The method of claim 1 wherein said perforating step further comprises perforating with a bromine trifluoride perforator.

5. The method of claim 1 wherein said perforating step further comprises perforating with a shaped-charged explosive.

6. The method of claim 1 further comprising, prior to making said temperature measuring step, pumping down said member a fluid having a temperature different from the temperature of the formation at said predetermined vertical depth to increase the temperature differential between the stuck and free sides of said member.

7. The method of claim 1 further comprising pumping an oil-base fluid down said member after said perforating step to facilitate the release of said member stuck against the wall of the wellbore.

8. The method of claim 7 further comprising pumping an oil-base fluid down said member before said perforating step to facilitate the release of said member stuck against the wall of the wellbore.

9. A method for freeing and releasing a hollow tubular member which has become stuck by differential pressure against the side wall of a wellbore, said method comprising the steps of:

measuring the differential temperature distribution around the circumference of said member at a predetermined vertical depth where said member is stuck by using a rotatable differential temperature sensing means, the measurement being made by:

lowering said sensing means to said predetermined depth, and rotating said sensing means about the interior of said member to measure temperature distribution around the interior of said member to determine which side of the member is stuck;

perfoating the side of said member determined to be stuck to place the interior of said member in fluid communication with the adjacent formation relieving the differential pressure between the member and the formation; and pumping an oil-base fluid down said member and through the perforation to further facilitate freeing said member from the side of the wellbore.

10. A method for freeing and releasing a hollow tubular member which has become stuck by differential pressure against the side wall of a wellbore, said wellbore comprising the steps of:

pumping down said member a fluid having a temperature different from the temperature of the formation at a predetermined vertical depth where said member is stuck to increase temperature differential between the stuck and free sides of said member;

measuring the differential temperature distribution around the circumference of the tubular member at said predetermined depth using a rotatable differential temperature sensing means having at least two circumferentially displaced temperature sensing devices connected to make a differential temperature measurement between at least two corresponding circumferentially displaced points around the interior circumference of said member, the measurement being made by:

(i) lowering said sensing means through said member to said predetermined depth; and (ii) rotating said sensing means around the interior of the tubular member at said predetermined depth to measure the temperature distribution around the circumference thereof to determine which side of said member is stuck against the side of the wellbore;

lowering a rotatable perforating means through said member along with the temperature sensing means, said perforating means being connected to and rotatable with said sensing means at a predetermined angular relationship with respect thereto;

positioning said perforating means to perforate the side of the member determined to be stuck against the wellbore to place the interior of said member in fluid communication with the adjacent formation;

actuating said perforating means when oriented toward the stuck side of said member to effect such fluid communication; and pumping an oil-base fluid down said member after said perforating step to facilitate the release of said member stuck against the side of the wellbore.

* * * * *